US008988241B2

(12) United States Patent
Tilvis et al.

(10) Patent No.: US 8,988,241 B2
(45) Date of Patent: Mar. 24, 2015

(54) PORTABLE APPARATUS

(75) Inventors: Marko Tilvis, Oulunsalo (FI); Pekka Rytky, Oulu (FI); Markku Karjalainen, Kempele (FI); Pertti Puolakanaho, Kiviniemi (FI)

(73) Assignee: Polar Electro Oy, Kempele (FI)

( * ) Notice: Subject to any disclaimer, the term of this patent is extended or adjusted under 35 U.S.C. 154(b) by 281 days.

(21) Appl. No.: 12/751,113

(22) Filed: Mar. 31, 2010

(65) Prior Publication Data

US 2010/0259407 A1 Oct. 14, 2010

(30) Foreign Application Priority Data

Apr. 8, 2009 (FI) ..... 20095386

(51) Int. Cl.

| | |
|---|---|
| ***G08B 21/00*** | (2006.01) |
| ***H04Q 5/22*** | (2006.01) |
| ***A61B 5/02*** | (2006.01) |
| ***A61B 5/04*** | (2006.01) |
| ***A63B 71/00*** | (2006.01) |
| ***A63B 24/00*** | (2006.01) |
| *A63B 21/00* | (2006.01) |

(Continued)

(52) U.S. Cl.

CPC ..... *A63B 24/0062* (2013.01); *A63B 21/00* (2013.01); *A63B 22/02* (2013.01); *A63B 22/0605* (2013.01); *A63B 24/0021* (2013.01); *A63B 2220/12* (2013.01); *A63B 2220/14* (2013.01); *A63B 2220/17* (2013.01); *A63B 2220/40* (2013.01); *A63B 2225/10* (2013.01); *A63B 2225/15* (2013.01); *A63B 2225/20* (2013.01); *A63B 2225/50* (2013.01); *A63B 2225/54* (2013.01); *A63B 2230/04* (2013.01); *A63B 2230/75* (2013.01)

USPC ..... 340/686.6; 340/10.1; 600/483; 600/508; 600/509; 482/8; 482/9

(58) Field of Classification Search

USPC ..... 434/258; 482/9, 8; 210/656; 377/24.2; 340/686.6, 691.8, 10.1–10.4; 600/300, 600/301, 483, 500, 509

See application file for complete search history.

(56) References Cited

U.S. PATENT DOCUMENTS 4,625,733 A 12/1986 Saynajakangas
5,113,869 A * 5/1992 Nappholz et al. ..... 600/508

(Continued)

FOREIGN PATENT DOCUMENTS

EP 1155715 A2 11/2001
EP 1755098 A2 2/2007

(Continued)

OTHER PUBLICATIONS

Lundblad, Hampus, European Search Report for corresponding European Application No. EP 10 15 8294, Aug. 6, 2010, pp. 1-2, Munich Germany.

*Primary Examiner* — Daniell L Negron
*Assistant Examiner* — Mohamed Barakat
(74) *Attorney, Agent, or Firm* — Hoffmann & Baron, LLP

(57) ABSTRACT

Interaction between a portable apparatus and a personal exercise area is disclosed. A method comprises: transferring wirelessly information between a personal exercise area and a portable apparatus; detecting proximity of the portable apparatus to the personal exercise area by utilizing the transferred information; and configuring the portable apparatus in relation to an exercise performed within the personal exercise area by a user of the portable apparatus.

12 Claims, 3 Drawing Sheets

(51) Int. Cl.

| | |
|---|---|
| *A63B 22/02* | (2006.01) |
| *A63B 22/06* | (2006.01) |

(56) References Cited

U.S. PATENT DOCUMENTS

| | | | | |
|---|---|---|---|---|
| 5,462,504 | A * | 10/1995 | Trulaske et al. | 482/7 |
| 5,931,763 | A | 8/1999 | Alessandri | |
| 6,132,337 | A * | 10/2000 | Krupka et al. | 482/8 |
| 6,506,142 | B2 * | 1/2003 | Itoh et al. | 482/8 |
| 6,768,919 | B2 * | 7/2004 | Starobin et al. | 600/520 |
| 7,310,549 | B1 * | 12/2007 | Angelini et al. | 600/509 |
| 7,811,201 | B1 * | 10/2010 | Mikan et al. | 482/4 |
| 7,828,697 | B1 * | 11/2010 | Oberrieder et al. | 482/8 |
| 7,951,046 | B1 * | 5/2011 | Barber, Jr. | 482/9 |
| 8,038,577 | B2 * | 10/2011 | McIntosh | 482/4 |
| 8,128,532 | B2 * | 3/2012 | Chen et al. | 482/8 |
| 2004/0198555 | A1 | 10/2004 | Anderson et al. | |
| 2005/0010426 | A1 | 1/2005 | Chen et al. | |
| 2006/0189440 | A1 * | 8/2006 | Gravagne | 482/8 |
| 2006/0252602 | A1 * | 11/2006 | Brown et al. | 482/9 |
| 2007/0016444 | A1 | 1/2007 | Holkkola | |
| 2007/0219059 | A1 | 9/2007 | Schwartz et al. | |
| 2008/0090703 | A1 * | 4/2008 | Rosenberg | 482/8 |
| 2009/0109049 | A1 * | 4/2009 | Frederick et al. | 340/686.6 |
| 2009/0280745 | A1 * | 11/2009 | Granqvist et al. | 455/41.3 |
| 2010/0203829 | A1 * | 8/2010 | Granqvist et al. | 455/41.1 |

FOREIGN PATENT DOCUMENTS

| | | | |
|---|---|---|---|
| WO | WO2006060472 | A1 | 6/2006 |
| WO | WO2007006857 | A1 | 1/2007 |
| WO | WO2007060616 | A2 | 5/2007 |

* cited by examiner

PORTABLE APPARATUS

CROSS-REFERENCE TO RELATED APPLICATION

This application claims priority based on Finnish Patent Application No. 20095386, filed Apr. 8, 2009, which is incorporated herein by reference.

BACKGROUND

1. Field

The invention relates to interaction between a portable apparatus and a personal exercise area.

2. Description of the Related Art

People exercise regularly in order to counteract the detrimental effect caused by the modern sedentary lifestyle. Exercise in specially designed exercise environments is becoming increasingly popular. The exercise environment may comprise a number of personal exercise areas. A personal exercise area is typically dedicated to a specific exercise and may include some sort of exercise equipment. Such equipment may include a computer-implemented user interface with which various exercise settings may be adjusted. A person exercising may additionally employ portable measurement equipment such as a heart rate monitor. In summary, a typical modern exercise environment may comprise a number of separate devices employing sophisticated data processing. However, people demand even more sophistication from their exercise environment, i.e. various equipment should interact seamlessly and as automatically as possible in order to enable people to concentrate on the exercise rather than on various user interfaces, settings, etc.

SUMMARY

The present invention seeks to provide an improved portable apparatus, an improved method, an improved computer program, and an improved apparatus of a personal exercise area.

According to an aspect of the present invention, there is provided a portable apparatus as specified in claim 1.

According to another aspect of the present invention, there is provided a method as specified in claim 11.

According to another aspect of the present invention, there is provided a computer program as specified in claim 12.

According to another aspect of the present invention, there is provided an apparatus of a personal exercise area as specified in claim 13.

BRIEF DESCRIPTION OF THE DRAWINGS

Embodiments of the present invention are described below, by way of example only, with reference to the accompanying drawings, in which.

DETAILED DESCRIPTION

The following embodiments are exemplary. Although the specification may refer to "an" embodiment in several locations, this does not necessarily mean that each such reference is to the same embodiment(s), or that the feature only applies to a single embodiment. Single features of different embodiments may also be combined to provide other embodiments.

Figure 1:
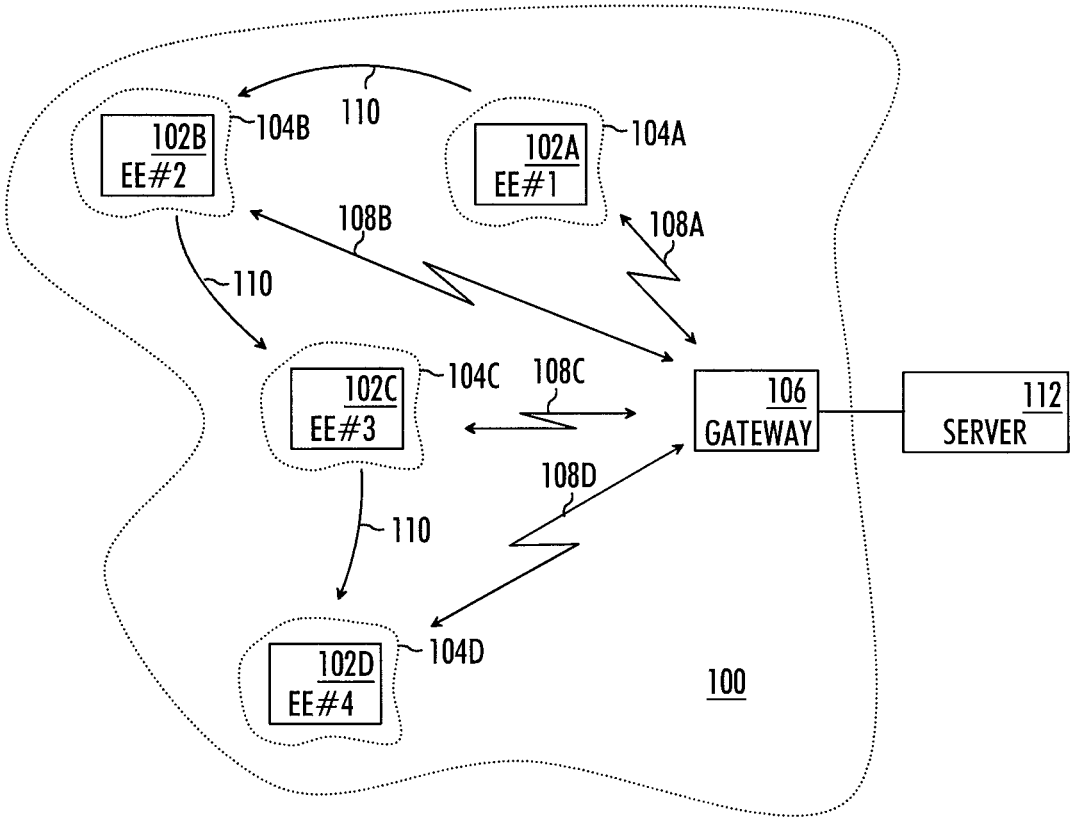
FIG. 1 illustrates an exercise environment.

FIG. 1 illustrates a modern exercise environment. Such environments may be fitness clubs, schools, swimming pools, hotel fitness areas, domestics fitness areas, etc. Such an exercise environment is formed by a complex infrastructure. Within this patent application, the exercise environment may be any environment which includes personal exercise areas. At the very least, the exercise environment comprises one personal exercise area.

In the embodiment of FIG. 1, an exercise area 100 comprises four personal exercise areas 104A, 104B, 104C, 104D. The personal exercise area 104A, 104B, 104C, 104D may be an area dedicated to an individual during the exercise. The personal exercise area 104A, 104B, 104C, 104D may be defined by the exercise to be carried out in the exercise area 104A, 104B, 104C, 104D, and/or by exercise equipment 102A, 102B, 102C, 102D, such as a treadmill, bike, or cross-training equipment.

In a typical exercise situation, a person goes 110 through several personal exercise areas 104A, 104B, 104C, 104D, each providing the person with different type of exercise. The sequence of exercise areas 104A, 104B, 104C, 104D may be defined by an exercise plan and/or an exercise goal of the person. In the prior art solutions, the person keeps a training diary on the exercise with pen and paper, and reads exercise instructions from paper.

Figure 3:
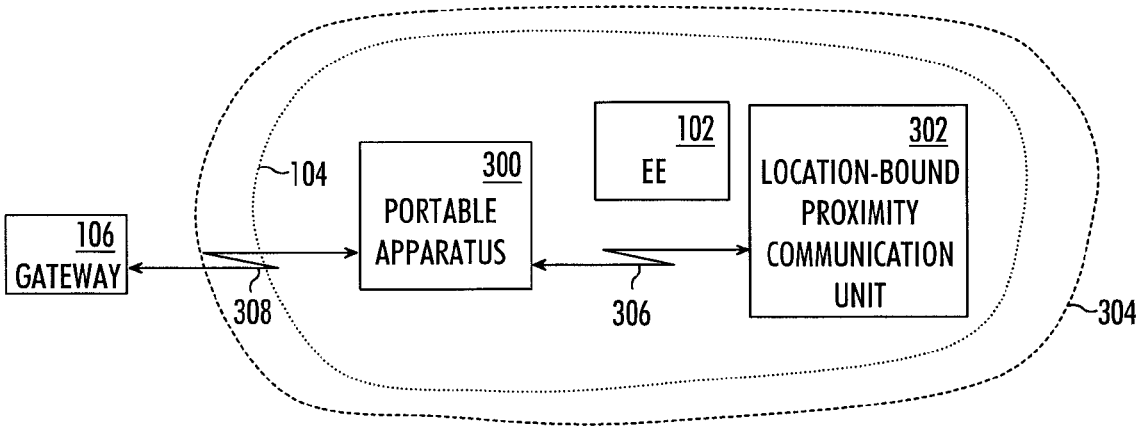

As illustrated in FIG. 3, the person carries a portable apparatus 300 while entering a personal exercise area 104, the personal exercise area 104 comprising exercise equipment 102.

It should be noted that while FIGS. 2, 3, 4, and 5 illustrate various embodiments of the portable apparatus 300 and a location-bound proximity communication unit 302, they are simplified block diagrams that only show some elements and functional entities, all being logical units whose implementation may differ from what is shown. The connections shown in these figures are logical connections; the actual physical connections may be different. Interfaces between the various elements may be implemented with suitable interface technologies, such as a message interface, a method interface, a sub-routine call interface, a block interface, or any means enabling communication between functional sub-units. It is apparent to a person skilled in the art that the described apparatuses 300, 302 may also comprise other functions and structures. It should be appreciated that some functions, structures, and elements, and the protocols used for communication are irrelevant to the actual invention. Therefore, they need not be discussed in more detail here. The specifications of apparatuses 300, 302 develop rapidly. Such development may require extra changes to an embodiment. Therefore, all words and expressions should be interpreted broadly and they are intended to illustrate, not to restrict, the embodiments. Although the apparatuses 300, 302 have been depicted as separate single entities, different parts may be implemented in one or more physical or logical entities.

Figure 4:
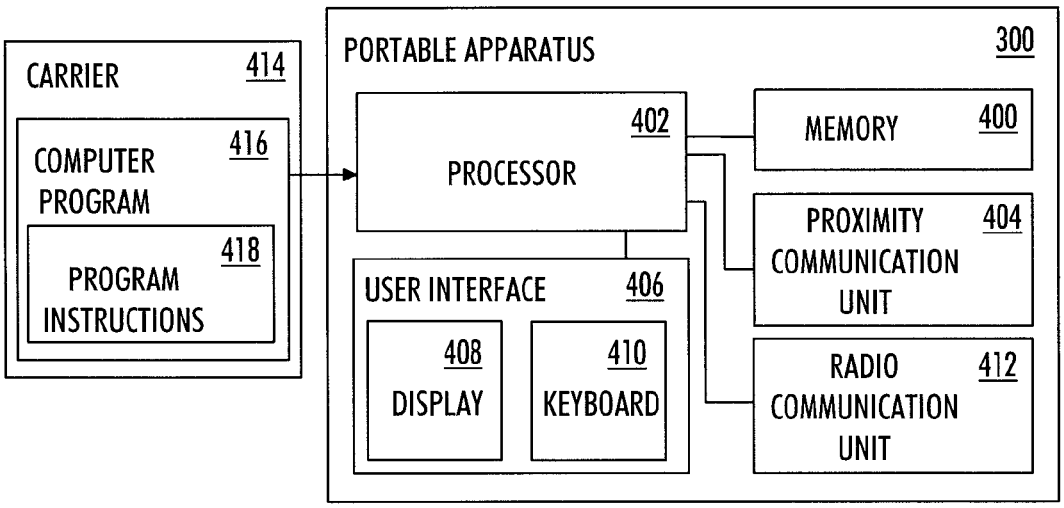

FIG. 4 illustrates an embodiment of the portable apparatus 300. The portable apparatus 300 may be a mobile apparatus, a sports computer, a running computer, a multi-sports computer, an activity monitor, a pedometer, a foot-pod, a shoe-mounted stride sensor, a measurement unit attachable to a lower limb of the user, and/or a subscriber terminal of a radio system (such as a mobile phone), for example. The portable apparatus 300 may also be a part of such an apparatus set, such as a heart rate transmitter, worn as a strap around chest of the user, for example. The term 'portable apparatus' 300 refers to a device that a user may move around by carrying it. The user interface part of the portable apparatus 300 may be worn around the wrist, like a watch, but it may well be implemented in another kind of platform, such as a subscriber terminal of a radio system: a mobile telephone for example. The user interface part may also be a sports watch for use as an instrument in sports. Polar Electro® (www.polarelectro-.com) designs and manufactures such apparatuses 300 and their accessories. At the time of filing this patent application, the portable apparatus 300 may be implemented based on a Polar sports computer FT80, for example. The implementation of the embodiments in such an existing product requires relatively small and well-defined modifications. Naturally, as the products evolve, feasible platforms for the implementation of the embodiments described in this patent application also evolve and emerge.

The portable apparatus 300 may be a heart rate monitor for measuring the user's heart rate and possibly other physiological parameters that can be measured from the user. In U.S. Pat. No. 4,625,733, which is incorporated herein by reference, Säynäjäkangas describes a wireless heart rate monitoring concept where a transmitter attached to the user's chest measures the user's heart rate and transmits heart rate information telemetrically to a heart rate receiver attached to the user's wrist. The transmission of the heart activity data may utilize the principles of time division and/or packet transmission, for example.

Other implementations may also be possible. The heart rate monitor may also be implemented such that the heart rate is directly measured from the wrist on the basis of pressure or optical measurement, for example. Other ways for measuring the heart rate may also be employed. As sensor technology becomes more integrated, less expensive, and its power consumption characteristics are improved, a sensor measuring heart activity data may also be placed in arrangements other than the chest strap transmitter. Polar Electro is already marketing apparels which comprise integrated electrode structures.

Figure 2:
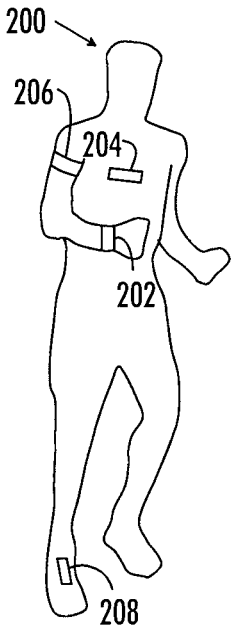
FIGS. 2, 3, 4, and 5 illustrate various embodiments of a portable apparatus and a location-bound proximity communication unit.

FIG. 2 illustrates an embodiment where the portable apparatus 300 is implemented as a running computer, such as Polar FT80. A runner 200 is provided with the following equipment: a wrist receiver 202, a heart rate transmitter 204, an upper-arm-mounted positioning receiver 206, and a shoe-mounted stride sensor 208. The accessories 204, 206, 208 communicate wirelessly with the wrist receiver 202.

The positioning receiver 206 receives external location information. The positioning receiver 206 may be a receiver of a global navigation satellite system. Such a system may be the Global Positioning System (GPS), the Global Navigation Satellite System (GLONASS), the Galileo Positioning System (Galileo), the Beidou Navigation System, or the Indian Regional Navigational Satellite System (IRNSS), for example. The positioning receiver 206 determines its location (longitude, latitude, and altitude) using signals transmitted from satellites orbiting the earth. Besides global navigation satellites, the positioning receiver 206 may also determine its location by utilizing other known positioning techniques. It is well known that by receiving radio signals from several different base stations, a mobile phone may determine its location.

In summary, the portable apparatus 300 may be such that it comprises at least one measurement sensor, which measures some aspect of the exercise. The measurement sensor may be an internal measurement sensor, which is physically coupled (by a wiring on a printed circuit board, for example) with the portable apparatus 300. The measurement sensor may also be a wireless external sensor. The wireless external sensor may be coupled by electric and/or magnetic radiation with a receiver (implemented by an integrated circuit, for example) of the portable apparatus 300. The measurement sensor may provide raw measurement data without further processing to the portable apparatus 300, or the measurement sensor may process the raw data before providing it to the portable apparatus 300.

The portable apparatus 300 may also be based on an existing activity monitor such as Polar Electro's FA20 Activity Computer. The measurement sensor may be an accelerometer. The accelerometer measures its own motion, acceleration, i.e. the rate of change in velocity, and converts the acceleration into an electric signal. The electric signal is converted into a digital format in an AD converter. Acceleration can be expressed by the unit of measurement g. One g is the acceleration caused to an object by earth's gravity. Accelerations between −2 and +2 g can usually be measured from human movement. Various techniques may be used for measuring acceleration. Piezo-resistor technology employs material whose resistance changes as it compresses. The acceleration of mass produces a force in a piezo resistor. If a constant current is supplied through the piezo resistor, its voltage changes according to the compression caused by acceleration. In piezo-electric technology, a piezo-electric sensor generates charging when the sensor is accelerated. In silicon bridge technology, a silicon chip is etched so that a silicon mass remains on it at the end of a silicon beam. When acceleration is directed to the silicon chip, the silicon mass focuses a force on the silicon beam, thus changing the resistance of the silicon beam. Micro-machined silicon technology is based on the use of a differential capacitor. Voice coil technology is based on the same principle as a microphone. Examples of suitable movement sensors include: Analog Devices ADXL105, Pewatron HW or VTI Technologies SCA series. The implementation of the accelerometer may also be based on other appropriate techniques, for example on a gyroscope integrated into a silicon chip or on a micro vibration switch incorporated into a surface mounting component.

The portable apparatus 300 may comprise a user interface 406. The user interface 406 may comprise a display 408, means for producing sound, and a keyboard 410 and/or a keypad. The display 408 may be a liquid crystal display, for example, but it may also be implemented by any appropriate prior art technique. The means for producing sound may be a loudspeaker or a simpler means for producing beeps or other sound signals. The keyboard/keypad 410 may comprise a complete qwerty keyboard, a mere numeric keypad or only a few push buttons and/or rotary buttons. In addition, the user interface 406 may comprise other prior art user interface elements, for example various means for focusing a cursor (mouse, track ball, various arrow keys, etc.) or elements enabling audio control. A parameter relating to the exercise, or a setting of the portable apparatus may be shown on the user interface 406, on the display, for example.

The portable apparatus 300 comprises a processor 402. The term 'processor' refers to a device that is capable of processing data. The processor 402 may comprise an electronic circuit implementing the required functionality, and/or a microprocessor running a computer program implementing the required functionality. When designing the implementation, a person skilled in the art will consider the requirements set for the size and power consumption of the apparatus, the necessary processing capacity, production costs, and production volumes, for example.

The electronic circuit may comprise logic components, standard integrated circuits, application-specific integrated circuits (ASIC), and/or other suitable electronic structures.

The microprocessor implements functions of a central processing unit (CPU) on an integrated circuit. The CPU is a logic machine executing a computer program, which comprises program instructions. The program instructions may be coded as a computer program using a programming language, which may be a high-level programming language, such as C, or Java, or a low-level programming language, such as a machine language, or an assembler. The CPU may comprise a set of registers, an arithmetic logic unit (ALU), and a control unit. The control unit is controlled by a sequence of program instructions transferred to the CPU from a program memory. The control unit may contain a number of microinstructions for basic operations. The implementation of the microinstructions may vary, depending on the CPU design. The microprocessor may also have an operating system (a dedicated operating system of an embedded system, or a real-time operating system), which may provide the computer program with system services.

The portable apparatus 300 comprises a proximity communication unit 404 configured to wirelessly transfer information 306 with a location-bound proximity communication unit 302 of the personal exercise area 104. Furthermore, the processor 402 is configured to detect proximity of the portable apparatus 300 to the personal exercise area 104 by utilizing the transferred information 306. The processor 402 may also be configured to detect that the proximity of the portable apparatus 300 to the personal exercise area 104 ceases by utilizing the transferred information 306, i.e. that the portable apparatus 300 leaves the personal exercise area 104.

The transferred information 306 may be any data that the portable apparatus 300 and the location-bound proximity communication unit 302 need to communicate to each other. The information may be specific to a user of the portable apparatus 300, specific to the portable apparatus 300, specific to the location-bound proximity communication unit 302, specific to the personal exercise area 104, or specific to the exercise equipment 102. The information may include a code identifying the personal exercise area 104, or a code identifying the exercise equipment 102.

The wireless transfer of information 306 between the portable apparatus 300 and the personal exercise area 104 may be unidirectional or bidirectional communication.

In an embodiment, the proximity communication unit 404 is configured to receive information associated with the personal exercise area 104 as the transferred information.

The term 'proximity communication' refers to a communication technology that takes place over relatively small distances. In FIG. 3, the personal exercise area 104 is encompassed by a range 304 of the location-bound proximity communication unit 302. The dimensions of the personal exercise area 104 may be such that the person stays within the bounds of the personal exercise area 104 during the exercise. As the personal exercise area 104 may also include the exercise equipment 102, the personal exercise area 104 may be such that it encompasses the exercise equipment 102. The range of the proximity connection may be such that the user is not required to approach any specific apparatus in order to connect. A suitable range may vary from 0.5 to 1.5 meters. The range may also be such that it encompasses a typical area of the personal exercise area 104, such as 1×1 meters or 1×2 meters, or a typical area of the exercise equipment 102.

The proximity communication may be implemented with an induction-based technology utilizing a magnetic field, or a radio-based technology utilizing electric radiation, for example. It is to be noted that both technologies involve both the magnetic field and the electric radiation, but the separation is based on the fact that either one of these physical phenomena predominates and is only used for communication in each technology. The induction-based transmission may operate at a kilohertz range frequency (5 kilohertz, 125 kilohertz, or over 200 kilohertz, for example). The radio transmission may utilize a proprietary transceiver (operating at a 2.4 gigahertz frequency, for example), or a Bluetooth transceiver, for example. Emerging ultra low power Bluetooth technology may also be used. Other suitable proximity communication techniques may include techniques based on light or sound, such as infrared communication or sonic communication. The proximity communication may utilize any suitable protocols: the principles of time division and/or packet transmission, for example.

A crucial difference between induction-based communication technology and the radio-based communication technology is signal attenuation as a function of the length of a signal propagation path. In the induction-based communication technology, the signal level is inversely proportional to the third power of the length of the signal propagation path, whereas in the radio-based technology, the signal level is inversely proportional to the second power of the length of the signal propagation path. This results in a dramatic difference in the spatial sensitivity of the communication. A typical coverage of the induction-based communication is of the order of human dimensions, i.e. about 1.5 meters.

Furthermore, the induction-based communication technology, especially in a 5-kilohertz range, is an advantageous option since an electromagnetic signal is insensitive to obstacles containing water, such as a human body, and thereby the person's orientation in the personal exercise area affects only slightly the proximity detection. In the case of radio communication, such as that operated at a gigahertz range, a radio signal is absorbed by a human tissue and the proximity detection is prone to failure.

The proximity communication unit 404 may be an induction-based transmitter and/or receiver, such as a kilohertz-range transmitter/receiver, a passive radio-frequency identification tag/tag reader, a coil-based inductive communication unit, or a near field communication transmitter/receiver, for example. The kilohertz-range transmission may operate at a 5-kilohertz frequency, for example. Higher frequencies, such as those exceeding 200 kilohertz, may also be possible. In an embodiment, the kilohertz-range includes 125 kilohertz. Near field communication may refer to a short-range high frequency wireless communication technology, also known as NFC, which enables communication over about a 10-centimeter distance. The proximity communication unit may also be a radio transmitter and/or receiver, such as a proprietary transmitter/receiver, or a Bluetooth transmitter/receiver, for example. Emerging ultra low power Bluetooth technology may be used. The proprietary radio transmission may operate at a 2.4-gigahertz frequency, for example. The radio transmission may also operate according to some WLAN (Wireless Local Area Network) standard.

Another noteworthy aspect in the proximity communication is the fact that each personal exercise area 104A, 104B, 104C, 104D should be positioned so that the ranges of location-bound proximity communication units 302 do not overlap with each other to such a degree as to interfere with each other. There may be many portable apparatuses 300 operating simultaneously, and as result of this, the location-bound proximity communication unit 302 does not know which portable apparatus 300 has entered the personal exercise area 104. Picture the following scenario in a health club: a user armed with the portable apparatus 300 wishes to exercise within the personal exercise area 102D, but the portable apparatus 300 cannot decide whether it is located within the personal exercise area 102C or 102D. Such a scenario may be solved by measuring the strength of the signal transmitted by the location-bound proximity communication units 302 at the portable apparatus 300, and selecting the personal exercise area 102D transmitting the strongest signal. Naturally, other suitable techniques for detecting which of the personal exercise areas 102C, 102D is nearer to the portable apparatus 300 may also be utilized.

The processor 402 is also configured to configure the portable apparatus 300 in relation to an exercise performed within the personal exercise area 104 by the user of the portable apparatus 300. The portable apparatus 300 may configure itself according to a code of the personal exercise area 104. An exercise program and its phase may be selected based on the identification of the personal exercise area 104.

In an embodiment, the processor 402 is configured to modify a measurement configuration of the portable apparatus 300 to be compatible with the personal exercise area 104 on the basis of the transferred information 306. The portable apparatus 300 may configure a measurement sensor and/or a measurement algorithm of the portable apparatus 300 so that the configuration is compatible with the personal exercise area 104. For example, if the personal exercise area 104 is an interval strength exercise site, the portable apparatus 300 may guide the person through a strength exercise where the intervals are controlled by heart rate information.

In an embodiment, the configuration of the portable apparatus 300 comprises adjusting performance guidance zones, such as heart rate zones or activity zones according to the requirements of the personal exercise area 104. A performance zone is a range defined by an upper and lower limit. Each performance zone is expected to provide a specific training response when followed by the user. The guidance zones may be displayed to the user graphically or numerically by the display 408. The user may also follow from the display 408 whether he/she is currently at the desired zone and also monitor how the training at each zone has been accumulated.

The performance guidance zone limits may reflect the use of muscles or muscle groups associated with a personal exercise area 104. For example, if the exercise in personal exercise area 104 is aimed at improving fitness, the heart rate guidance zones may be adjusted such that the lower and intermediate heart rate zones dominate. On the other hand, if the personal exercise area 104 is aimed at improving maximum capacity, the higher heart rate zones may dominate.

Additionally, a wrist unit of the portable apparatus 300 may comprise an accelerometer, and an accelerometer algorithm may be configured so that it is suitable for measuring the quality, repetition and/or range of motion in the specific strength exercise. It is also possible that the person follows a cardiovascular training program, and the portable apparatus 300 is configured to guide through it. It may be possible that different personal exercise areas 104A, 104B, 104C, 104D, and/or exercise equipment 102A, 102B, 102C, 102D are associated with different heart rate zones in order to provide an optimum training effect. Consequently, modification of the measurement configuration may be carried out by adapting the heart rate zone according to the characteristics of the personal exercise area 104.

In an embodiment, the portable apparatus 300 further comprises a memory 400. The processor 402 may be configured to start storing exercise data measured from the exercise into the memory 400 after having detected the proximity of the portable apparatus 300 to the personal exercise area 104. Additionally, or alternatively, the processor 402 may be configured to store exercise data measured from the exercise into the memory 400 in such a manner that the stored exercise data is associated with the personal exercise area 104. The processor 402 may also be configured to stop storing the exercise data after having detected that the proximity of the portable apparatus 300 to the personal exercise area 104 ceases. This enables the person to monitor the duration of the exercise, energy consumption and/or number of repetitions at that specific personal exercise area 104, for example. Such an analysis may be performed after the exercise.

The exercise data is data which characterizes at least one aspect of an exercise.

In an embodiment, the exercise data comprises heart rate data, which may have a form of heart beat intervals, heart rate or heart rate variability. In this case, the measurement sensor comprises a heart activity detector which may be based on optical measurement or electric measurement from the user's chest, for example.

In an embodiment, the exercise data comprises EKG (Electrocardiogram) data, which characterises electric potential associated with heart muscle activity in at least one spatial direction. In this case, the measurement sensor comprises a heart activity detector which may be based electric measurement from the user's chest, for example.

In an embodiment, the exercise data comprises motion data associated with body movements during exercise. The motion data may be acceleration values, or motion parameters, such as velocities, distances or pulses derived from the acceleration values.

In an embodiment, the portable apparatus 300 further comprises a user interface 406. The processor 402 may be configured to output exercise instructions relevant to the personal exercise area 104 with the user interface 406. The exercise instructions may comprise power training instructions, heart rate instructions, and/or recovery period instructions. The portable apparatus 300 may show the person exercise instructions which are relevant to the specific personal exercise area 104. The exercise instructions may have been loaded into the portable apparatus 300 before entering the personal exercise area. Alternatively, a radio connection 308 or the proximity connection 306 may be used to transfer the instructions.

If the portable apparatus 300 is configured to provide exercise instructions specific to a personal exercise area 104, a question arises as to how the exercise instructions are transferred into the portable apparatus 300. A modern fitness environment may include a variety of different exercise equipment which each involve different exercise instructions. Furthermore, the instructions may be tailored specifically for the person.

The exercise instructions may have been programmed into the portable apparatus 300 during the manufacture process. Personal exercise preferences may be taken into account.

The person may download the exercise instructions from a website. The website may be provided by a fitness club or a school, for example. The web service may show the available exercise equipment, and the person may select equipment he/she wishes to use. After that, parameters associated with the selected equipment may be downloaded into the portable apparatus 300, and the exercise instructions may be generated based on the equipment parameters and user preferences.

The exercise instructions may be generated in the web service. The web service is provided with personal information and user preferences and parameters of the available equipment. The person may select the desired equipment, and the exercise instructions are generated.

The exercise instruction may be downloaded to the person's portable apparatus 300 when the person enters the exercise area 100 and/or when the person enters the personal exercise area 104.

Exercise instructions for each personal exercise area 104 may comprise the following elements: number of repetitions, number of series, exercise load, range of motion, weights and settings of exercise equipment, suitable heart rate ranges, recovery periods between series within personal exercise areas, recovery periods between personal exercise areas, and/or information (such as text, images, animation and/or videos) about the correct performance technique of the exercise.

In an embodiment, the processor 402 may be configured to output information on the next available and/or suitable (from the point of view of training) personal exercise area 104 with the user interface. The availability information may be transferred to the portable apparatus 300 via the radio connection 308 or the proximity connection 306.

In an embodiment, the portable apparatus 300 further comprises a radio communication unit 412. The processor 402 may be configured to transmit user-specific exercise equipment configuration data for configuring the exercise equipment 102 of the personal exercise area 104 with the radio communication unit 412. By configuring the exercise equipment 102, training load may be regulated, for example. The user preferences may comprise information on the exercise goal (strength, cardiovascular fitness, maximum performance, etc). The portable apparatus 300 may also transmit exercise data to a gateway 106 which further transmits the exercise data to a server 112.

In an embodiment, the proximity communication unit 404 is further configured to receive information relating to the exercise, and/or the portable apparatus 300 further comprises a radio communication unit 412 configured to receive information relating to the exercise. The processor 402 may be configured to process the received information relating to the exercise. The information may be heart activity data such as heart rate limits, status information of the exercise equipment 102, training schedules, equipment identification information, user information, registration information, etc.

FIG. 4 also illustrates a computer program 416 that may be run on the processor 402. The computer program 416 may be in source code form, object code form, or in some intermediate form, and it may be stored in a carrier 414, which may be any entity or device capable of carrying the program to the portable apparatus 300. The carrier 414 may be implemented as follows, for example: the computer program 416 may be embodied on a record medium, stored in a computer memory, embodied in a read-only memory, carried on an electrical carrier signal, carried on a telecommunications signal, and/or embodied on a software distribution medium. The computer program 416 on the carrier 414 comprises program instructions 418 which, when loaded into the portable apparatus 300, cause the portable apparatus 300 to wirelessly transfer information with the personal exercise area 104, to detect proximity of the portable apparatus 300 to the personal exercise area 104 by utilizing the transferred information, and to configure the portable apparatus 300 in relation to an exercise performed within the personal exercise area 104 by a user of the portable apparatus 300.

Figure 5:
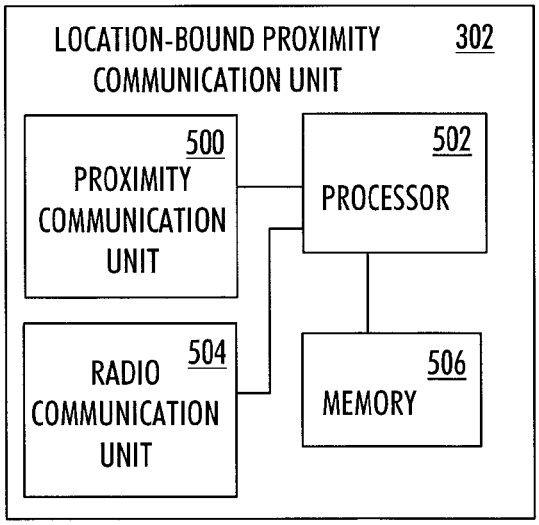

FIG. 5 illustrates an embodiment of an apparatus of the personal exercise area 104. The apparatus comprises a location-bound proximity communication unit 302 configured to wirelessly transmit information associated with the personal exercise area 104 to the proximity communication unit 404 of the portable apparatus 300. The location-bound proximity communication unit 302 comprises an actual proximity communication unit 500 providing a proximity connection for the portable apparatus 300. The term 'apparatus of the personal exercise area' refers to a device capable of communicating with the portable apparatus 300. Such an apparatus may be a computer, an exercise apparatus, a health club apparatus, an electronic circuit implementing the described behaviour, or, in its simplest form, the location-bound proximity communication unit 302 may be a single inductive transmitter primarily transmitting a code associated with the personal exercise area 104 or with the exercise equipment 102. The code may be programmed in a memory 506 during manufacture or service of the location-bound proximity communication unit 302. The portable apparatus 300 may receive the code, and detect the proximity. The code may be based on a time code, for example, where the distance of successive signals defines the code. The coding may also be implemented with frequency modulation. The location-bound proximity communication unit 302 may comprise some of the following properties:

- adjustable direction and strength in the communication field so that the personal exercise area 104 is covered. The direction may be adjusted by directing an antenna element, such as an induction coil, in a desired direction. The strength of the communication field may be adjusted by the gain of a signal;
- a small-sized battery-operated stand-alone unit, which may easily be located close to the exercise equipment 102, wireless or wired connection to a network (to the server 112 through the gateway 106);
- collection of log information regarding the use of the personal exercise area 104, which log information may be used for monitoring the use of the exercise equipment 102 and for assisting in charging the person for using it;
- may be integrated into the exercise equipment 102, for example into a heart rate detection component; and
- may utilize infrastructure, such as a casing, power supply and communication interface (LAN, WLAN) of the exercise equipment 102.

Alternatively, the location-bound proximity communication unit 302 may be a receiver receiving a signal from the portable apparatus 300, and detecting the proximity of the portable apparatus 300. The detection may initiate a radio connection with a radio communication unit 504 between the location-bound proximity communication unit and the portable apparatus 300, and the portable apparatus 300 is informed via the radio connection about the proximity.

Depending on the required processing capability, the location-bound proximity communication unit 302 may comprise a processor 502 configured to process data.

FIG. 1 also illustrates that each personal exercise area 104A, 104B, 104C, 104D (and/or a location-bound proximity communication unit 302, and/or exercise equipment 102A, 102B, 102C, 102D within the personal exercise area, for example) may communicate 108A, 108B, 108C, 108D through a gateway 106 with a server 112. Furthermore or alternatively, as illustrated in FIG. 3, the portable apparatus 300 may communicate 308 through the gateway 106 with the server 112. The gateway 106 provides the actual wireless radio connection. The server 112 may be provided by the exercise area operator. The server 112 may collect wirelessly exercise information from the portable apparatuses 300. The exercise information may be monitored by a personal trainer or a teacher of the person, and it may be made available to the user via a web service, for example. The server 112 may belong to a computer network, such as the Internet or a private network. The server 112 may provide exercise data storage and analysis services to a wide audience, as a world-wide web (WWW) server over the Internet, for example.

Generally speaking, the portable apparatus 300 may comprise means for wirelessly transferring information with a location-bound proximity communication unit of a personal exercise area; means for detecting proximity of the portable apparatus to the personal exercise area by utilizing the transferred information; and means for configuring the portable apparatus in relation to an exercise performed within the personal exercise area by a user of the portable apparatus.

Figure 6:
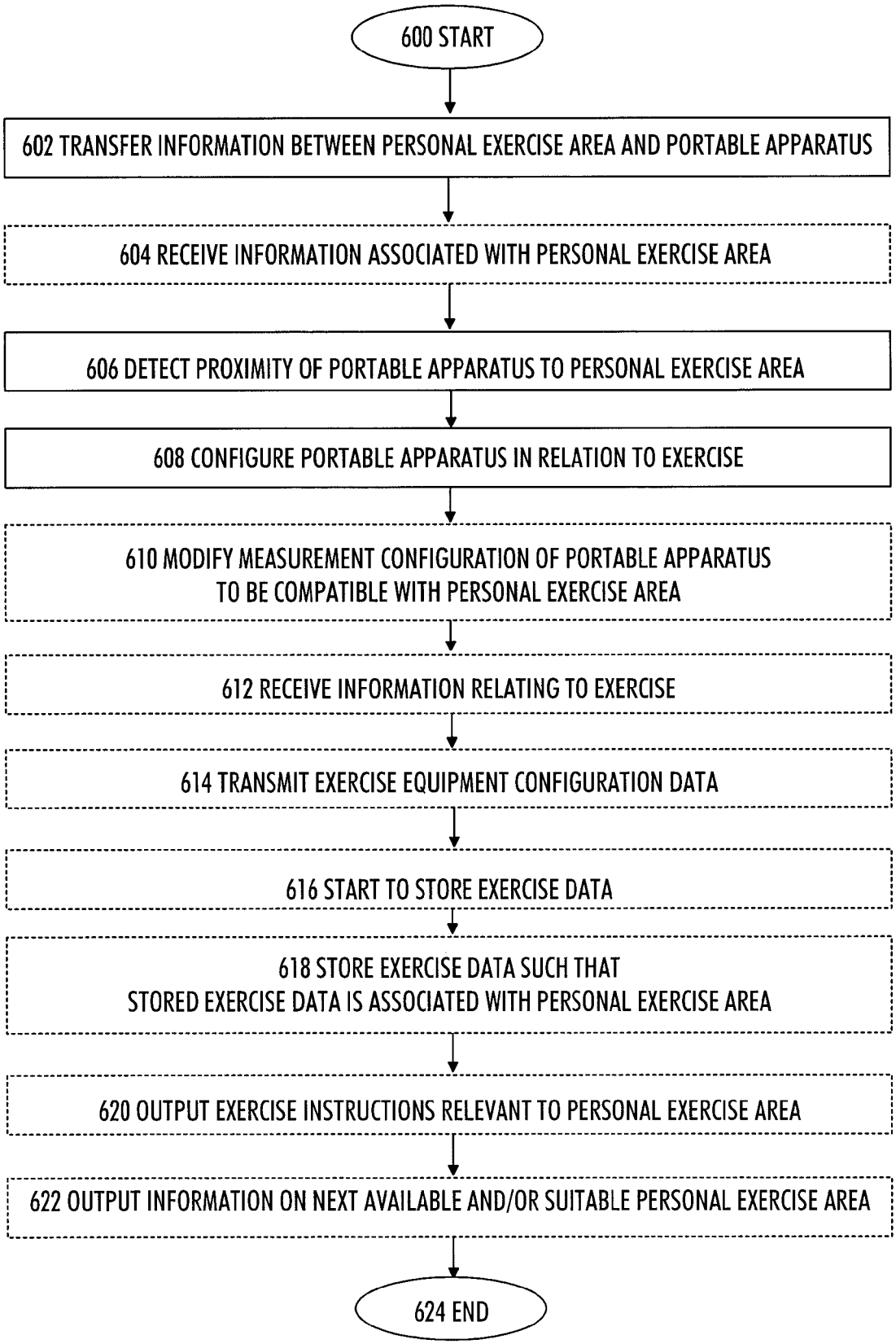
FIG. 6 is a flow-chart illustrating various embodiments of a method.

Next, a method will be described with reference to FIG. 6. Other functions, not described in this application, may also be executed between the operations or within the operations. Some of the operations or parts of the operations may also be left out or replaced by a corresponding operation or part of the operation. The method starts in 600. In 602, information is wirelessly transferred between a personal exercise area and a portable apparatus. In 606, proximity of the portable apparatus to the personal exercise area is detected by utilizing the transferred information. In 608, the portable apparatus is configured in relation to an exercise performed within the personal exercise area by a user of the portable apparatus. The method ends in 624. The embodiments of the portable apparatus 300 may also be used to enhance the method.

Next, eight embodiments of the method will be described. These embodiments may be freely combined with each other in order to produce further embodiments.

In embodiment 604, the method further comprises: receiving information associated with the personal exercise area as the transferred information by the portable apparatus.

In embodiment 610, the method further comprises: modifying a measurement configuration of the portable apparatus to be compatible with the personal exercise area on the basis of the transferred information.

In embodiment 616, the method further comprises: starting to store exercise data measured from the exercise after having detected the proximity of the portable apparatus to the personal exercise area.

In embodiment 618, the method further comprises: storing exercise data measured from the exercise in such a manner that the stored exercise data is associated with the personal exercise area.

In embodiment 620, the method further comprises: outputting exercise instructions relevant to the personal exercise area by the portable apparatus. The exercise instructions may comprise power training instructions, heart rate instructions, and/or recovery period instructions, for example.

In embodiment 622, the method further comprises: outputting information on the next available and/or suitable personal exercise area by the portable apparatus.

In embodiment 614, the method further comprises: transmitting user-specific exercise equipment configuration data for configuring exercise equipment of the personal exercise area from the portable apparatus.

In embodiment 612, the method further comprises: receiving information relating to the exercise by the portable apparatus.

It will be obvious to a person skilled in the art that, as technology advances, the inventive concept can be implemented in various ways. The invention and its embodiments are not limited to the examples described above but may vary within the scope of the claims.

What is claimed is:

1. A portable apparatus comprising:

a proximity communication unit configured to wirelessly transfer information with a plurality of location-bound proximity communication units, each of the plurality of location-bound proximity communication units being associated with one of a plurality of personal exercise areas, the proximity communication unit communicating the information while the proximity communication unit is within a plurality of ranges, the plurality of ranges being non-overlapping so as to not interfere with each other, each of the plurality of non-overlapping ranges being associated with at least one of the plurality of personal exercise areas;

a processor configured to detect proximity of the portable apparatus to at least one of the plurality of personal exercise areas by utilizing the communicated information, and to configure the portable apparatus to be compatible with an exercise performed within the at least one detected personal exercise area by a user of the portable apparatus;

a heart rate measurement sensor configured to measure heart rate data from the user; and a memory into which the processor is further configured to store the heart rate data measured from the exercise in such a manner that the stored heart rate data is associated with the detected personal exercise area, wherein the configuration of the portable apparatus comprises adjusting heart rate guidance zones according to at least one heart rate limit instruction transmitted from the personal exercise area, the heart rate guidance zones being defined by a lower limit and a higher limit.

2. The apparatus of claim 1, wherein the proximity communication unit is further configured to receive information associated with the personal exercise area as the communicated information.

3. The apparatus of claim 1, wherein the processor is further configured to modify a measurement configuration of the portable apparatus to be compatible with the personal exercise area on the basis of the communicated information.

4. The apparatus of claim 1, wherein the portable apparatus further comprises a memory, and the processor is further configured to start storing heart rate data measured from the exercise into the memory after having detected the proximity of the portable apparatus to the personal exercise area.

5. The apparatus of claim 1, wherein the portable apparatus further comprises a user interface, and the processor is further configured to output exercise instructions relevant to the personal exercise area with the user interface.

6. The apparatus of claim 1, wherein the portable apparatus further comprises a user interface, and the processor is further configured to output information on a next available and/or suitable personal exercise area with the user interface.

7. The apparatus of claim 1, wherein the portable apparatus further comprises a radio communication unit, and the processor is further configured to transmit user-specific exercise equipment configuration data for configuring exercise equipment of the personal exercise area with the radio communication unit.

8. The apparatus of claim 1, wherein the proximity communication unit is further configured to receive information relating to the exercise, and the processor is further configured to process the received information relating to the exercise.

9. The apparatus of claim 1, wherein the portable apparatus further comprises a radio communication unit configured to receive information relating to the exercise, and the processor is further configured to process the received information relating to the exercise.

10. A method comprising:

transferring, wirelessly, information between a portable apparatus and a plurality of location-bound proximity communication units, each of the location-bound proximity communication units being associated with one of a plurality of personal exercise areas, the portable apparatus communication the information while the portable apparatus is within a plurality of ranges, the plurality of ranges being non-overlapping so as to not interfere with each other, each of the plurality of non-overlapping ranges being associated with at least one of the plurality of personal exercise areas;

detecting, using the portable apparatus, proximity of the portable apparatus to at least one of the plurality of personal exercise areas by utilizing the communicated information;

configuring the portable apparatus to be compatible with an exercise performed within the detected personal exercise area by a user of the portable apparatus;

measuring heart rate data, using a sensor, from the user; and storing the heart rate data measured from the exercise, in a storage device in such a manner that the stored heart rate data is associated with the at least one detected personal exercise area, wherein the configuration of the portable apparatus comprises adjusting heart rate guidance zones according to at least one heart rate limit instruction transmitted from the personal exercise area, the heart rate guidance zones being defined by a lower limit and a higher limit.

11. A non-transitory computer-readable medium comprising instructions that, when executed by a computing device, cause the computing device to perform operations comprising:

transferring, wirelessly, information between a portable apparatus and a plurality of location-bound proximity communication units, each of the location-bound proximity communication units being associated with one of a plurality of personal exercise areas, the portable apparatus communicating the information while the portable apparatus is within a plurality of ranges, the plurality of ranges being non-overlapping so as to not interfere with each other, each of the plurality of non-overlapping ranges being associated with at least one of the plurality of personal exercise areas;

detecting proximity of the portable apparatus to at least one of the plurality of personal exercise areas by utilizing the communicated information;

configuring the portable apparatus to be compatible with an exercise performed within the detected personal exercise area by a user of the portable apparatus;

measuring heart rate data from the user; and storing the heart rate data measured from the exercise in such a manner that the stored exercise data is associated with the at least one detected personal exercise area, wherein the configuration of the portable apparatus comprises adjusting heart rate guidance zones according to at least one heart rate limit instruction transmitted from the personal exercise area, the heart rate guidance zones being defined by a lower limit and a higher limit.

12. An apparatus of a personal exercise area, comprising a location-bound proximity communication unit configured to wirelessly transmit information associated with one of a plurality of personal exercise areas to a proximity communication unit of a portable apparatus, the location-bound proximity communication unit being associated with one of the plurality of personal exercise areas, the location-bound proximity communication unit being configured such that the location-bound proximity communication unit communicates the information while the portable apparatus is within a plurality of ranges, the plurality of ranges being non-overlapping so as to not interfere with each other, each of the plurality of non-overlapping ranges being associated with at least one of the plurality of personal exercise areas, wherein the transmitted information includes at least one personal exercise area heart rate limit instruction related to the personal exercise area, the transmitted information being configured to be processed by the portable apparatus for adjusting heart rate guidance zones, the heart rate guidance zones being defined by a lower limit and a higher limit.

* * * * *

UNITED STATES PATENT AND TRADEMARK OFFICE

CERTIFICATE OF CORRECTION

PATENT NO. : 8,988,241 B2
APPLICATION NO. : 12/751113
DATED : March 24, 2015
INVENTOR(S) : Marko Tilvis et al.

It is certified that error appears in the above-identified patent and that said Letters Patent is hereby corrected as shown below:

IN THE CLAIMS

Column 13, line 2 (Claim 10)

Now reads: "...apparatus communication the ..."

Should read: "...apparatus communicating the ..."

Signed and Sealed this
Twenty-third Day of February, 2016

Michelle K. Lee

Michelle K. Lee
*Director of the United States Patent and Trademark Office*